US005290194A

United States Patent [19]

Sneddon et al.

[11] Patent Number: 5,290,194

[45] Date of Patent: Mar. 1, 1994

[54] SWIM FIN WITH DIFFERENTIAL STIFFNESS CHARACTERISTICS

[75] Inventors: Thomas M. Sneddon, Panorama City; Antoine J. Bordier, Studio City, both of Calif.

[73] Assignee: Kransco, San Francisco, Calif.

[21] Appl. No.: 48,473

[22] Filed: Apr. 16, 1993

[51] Int. Cl.[5] ..... A63B 31/10

[52] U.S. Cl. ..... 441/64

[58] Field of Search ..... 441/63, 64

[56] References Cited

U.S. PATENT DOCUMENTS

| | | | |
|---|---|---|---|
| Re. 23,006 | 6/1948 | Churchill . | |
| 1,074,595 | 10/1913 | Aumont . | |
| 1,571,462 | 2/1926 | Waldron et al. . | |
| 1,793,937 | 2/1931 | Knudsen . | |
| 2,099,973 | 11/1937 | Corlieu . | |
| 2,179,124 | 11/1939 | Jesnig | 36/8.1 |
| 2,321,009 | 6/1943 | Churchill | 441/64 |
| 2,332,252 | 10/1943 | Payne | 36/8.1 |
| 2,343,468 | 3/1944 | Messinger . | |
| 2,541,738 | 2/1951 | Bassichis . | |
| 2,588,363 | 3/1952 | De Corlieu | 441/64 |
| 2,865,033 | 12/1958 | Jayet | 441/64 |
| 2,889,563 | 6/1959 | Lamb et al. | 441/64 |
| 2,903,719 | 9/1959 | Wozencraft | 441/64 |
| 2,950,487 | 8/1960 | Woods | 36/8.1 |
| 2,954,617 | 10/1960 | Yamaguchi | 36/8.1 |
| 3,042,943 | 7/1962 | Katehis | 441/64 |
| 3,107,372 | 10/1963 | Brown et al. | 441/64 |
| 3,112,503 | 12/1963 | Girden | 441/64 |
| 3,178,738 | 4/1965 | La Trell | 441/64 |
| 3,239,857 | 3/1966 | Gwynne | 441/64 |
| 3,302,222 | 2/1967 | Ferraro | 441/64 |
| 3,605,292 | 9/1971 | Goldblatt . | |
| 3,640,006 | 2/1972 | Kendrick | 36/8.1 |
| 3,676,940 | 7/1972 | Shively | 36/8.1 |
| 3,683,519 | 8/1972 | Creamer | 36/8.1 |
| 3,922,741 | 12/1975 | Semeia | 441/64 |
| 3,936,896 | 2/1976 | Creamer . | |
| 3,952,351 | 4/1976 | Gisbert | 441/64 |
| 4,083,071 | 4/1978 | Forjot | 441/64 |
| 4,322,894 | 4/1982 | Dykes | 36/8.1 |
| 4,495,715 | 1/1985 | Fredrickson et al. | 36/113 |
| 4,521,220 | 6/1985 | Schoofs | 441/64 |
| 4,627,820 | 12/1986 | Penebre | 441/64 |
| 4,645,466 | 2/1987 | Ellis | 441/74 |
| 4,689,029 | 8/1987 | Ciccotelli | 441/64 |
| 4,775,345 | 10/1988 | Gifford | 441/75 |
| 4,778,423 | 10/1988 | Ciccotelli | 441/64 |
| 4,884,986 | 12/1989 | Gil | 441/60 |
| 4,889,510 | 12/1989 | Piatt | 441/61 |
| 4,940,437 | 7/1990 | Piatt | 441/64 |
| 4,948,385 | 8/1990 | Hall | 441/64 |
| 4,952,183 | 8/1990 | Gil | 441/64 |
| 4,954,111 | 9/1990 | Cressi | 441/64 |
| 4,954,112 | 9/1990 | Negrini et al. | 441/64 |
| 4,973,049 | 11/1990 | Ciolino | 441/61 |
| 5,041,039 | 8/1991 | Chang | 441/64 |
| 5,108,328 | 4/1992 | Hull | 441/64 |
| 5,139,450 | 8/1992 | Steele | 441/64 |

FOREIGN PATENT DOCUMENTS

| | | | |
|---|---|---|---|
| 436927 | 7/1991 | European Pat. Off. | 441/64 |
| 1172572 | 8/1985 | U.S.S.R. | 441/64 |

OTHER PUBLICATIONS

*Swimming World*, vol. 26, No. 4, Apr. 1985, pp. 37–40.

*Primary Examiner*—Jesus D. Sotelo

*Attorney, Agent, or Firm*—Kolisch, Hartwell, Dickinson, McCormack & Heuser

[57] ABSTRACT

A swim fin having differential stiffness characteristics is provided which includes shoe and blade portions, the shoe portion being configured to receive a swimmer's foot and the blade portion being configured to provide the desired hydrodynamic effect. The shoe portion defines a cavity which is formed in part by a differential stiffness expanse which overlies the forepart of the user's foot. The expanse includes a resilient toe region which covers the swimmer's toes and a less resilient instep region which covers the instep of the swimmer's foot. The blade portion extends from the shoe portion and is operatively connected to the instep region so as to provide the wearer with instep-directed blade portion control.

7 Claims, 1 Drawing Sheet

FIG. 1
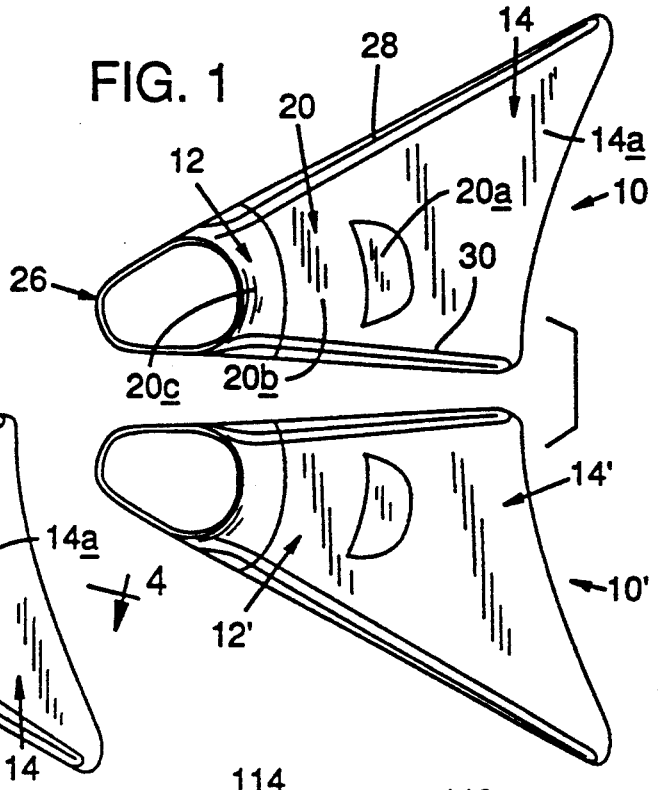
FIG. 2
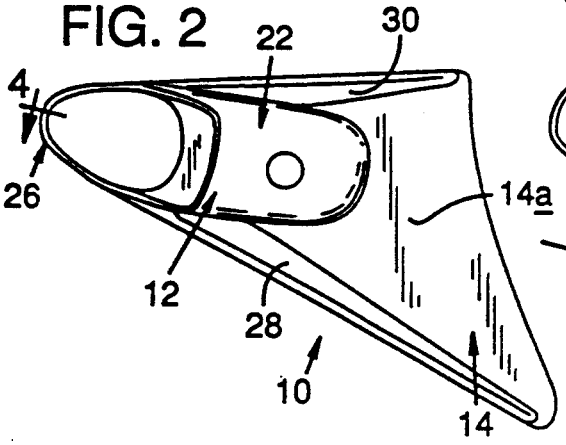
FIG. 5
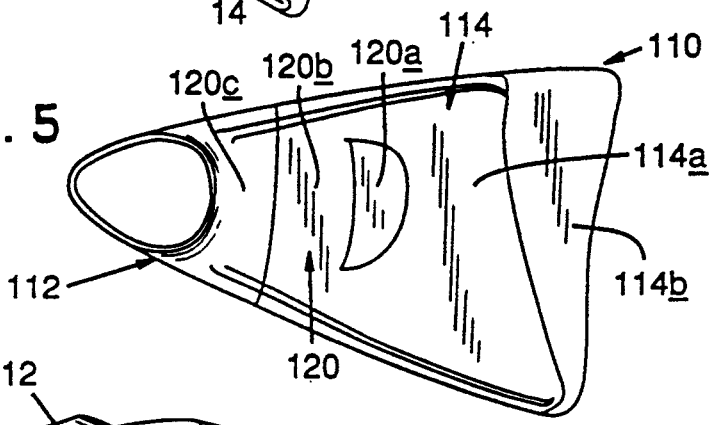
FIG. 3
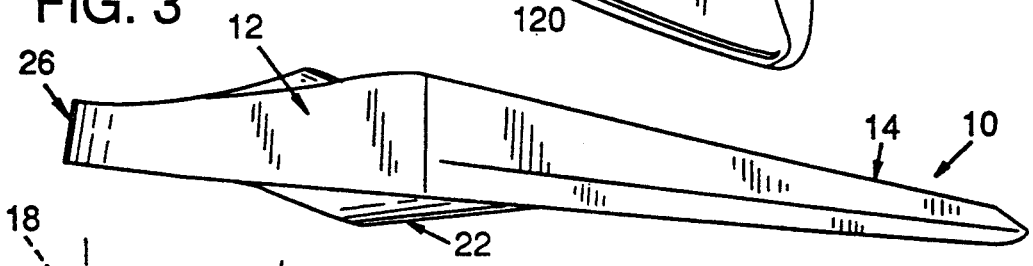
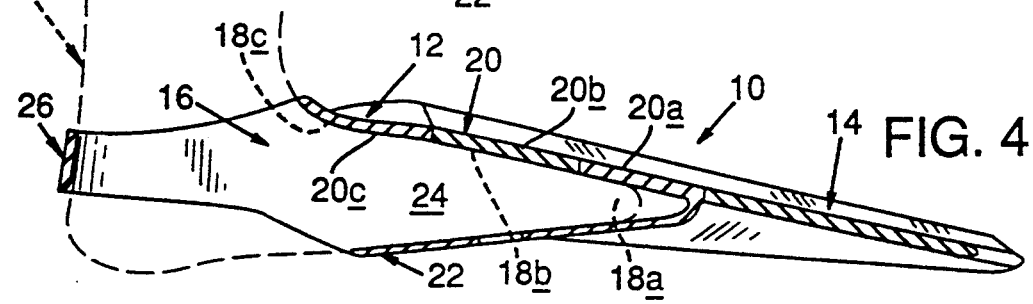
FIG. 4

SWIM FIN WITH DIFFERENTIAL STIFFNESS CHARACTERISTICS

TECHNICAL FIELD

The present invention relates generally to swimming accessories, and more particularly to a fin of the type worn by swimmers to improve their speed and agility during aquatic pursuits. The invented fin is configured for ready attachment to a swimmer's foot and is provided with differential stiffness characteristics which enhance the wearer's comfort without detracting significantly from the fin's advantageous hydrodynamic effects. Although not specifically required, the fin is normally worn in pairs, each fin being attached to a corresponding one of the user's feet.

BACKGROUND ART

In recent years, sports such as snorkeling, bodyboarding and surfing have become increasingly popular activities, providing participants with enjoyable forms of both exercise and recreation. These activities are similar in that they all involve swimming, an endeavor which entails self-directed propulsion of an individual through the water. Most will recognize, however, that the human body is not particularly well suited for such propulsion, owing primarily to the relatively small size of human hands and feet. Hence arises a demand for accessories which increase the effective size of a swimmer's appendages so as to better accommodate the swimmer's propulsion and enhance the swimmer's maneuverability while engaging in aquatic pursuits.

Swimming accessories of the type just described typically take the form of artificial fins which attach to the swimmer's feet. Such fins, commonly known as swim fins, include a shoe portion which receives the swimmer's foot and a blade portion which provides the desired propulsive force when the swimmer kicks his or her feet. The blade portion generally extends forwardly from the shoe portion, increasing the effective size of the swimmer's foot so as to provide a suitably sized surface against which water may pass during a power stroke. One particularly popular swim fin is illustrated in U.S. Pat. No. Re.23,006 to O. P. Churchill, such patent disclosing the well-known CHURCHILL® fin. The disclosure of that patent is incorporated herein by this reference thereto.

As will be appreciated by most water enthusiasts, swim fins are commonly formed of a resilient material which allows the fin's wearer to maintain a certain amount of comfort while the fin is in use. Such fins, however, may fail to provide the swimmer with the control necessary to ensure that the swimmer achieve the desired hydrodynamic effect. To address this problem, fins are sometimes formed of a relatively stiff material, making for greater water resistance and thus an improved propulsion effect. Stiffness, however, is not an advantageous characteristic in the shoe portion of the swim fin, stiff materials tending to detract significantly from the wearer's comfort, making the fins unbearable to wear. Such fins may also result in problems related to achieving proper fit, and may interfere with blood circulation, possibly endangering the swimmer's life. What is needed is a fin which exhibits the desired stiffness characteristics in the blade portion while maintaining the desired resiliency characteristics in the shoe portion of the fin. It is therefore an object of this invention to provide a swim fin which exhibits differential stiffness characteristics so as to improve the wearer's comfort without compromising the fin's propulsion-enhancing effect.

In the past, swim fins with differential stiffness characteristics have been proposed, such fins commonly including a skeletal framework intended to reinforce the blade portion without compromising resiliency in the shoe portion of the fin. At least one known fin includes a framework which is constructed of metal strips and enclosed in a molded material such as rubber. Such an arrangement, however, presents an unacceptable risk to the wearer due to the chance of injury should the skeletal framework puncture the fin's skin. This situation is particularly dangerous in the context of aquatic sports where an injury which immobilizes the swimmer could possibly lead to the swimmer's drowning or serious bodily harm. Other problems relate to the weight of the fins and the complexity of their design.

Other differential stiffness swim fins have also been proposed wherein the blade and shoe portions are separately formed and then fastened together by way of a complementary coupling structure. Using such an arrangement it is possible to construct a fin having a shoe portion which is formed from a relatively resilient material and a blade portion which is formed of relatively stiff material, resulting in a differential stiffness composite fin. Although these fins take steps toward enhancing the wearer's comfort, several important problems remain. First, composite fins of the type just described do little in the way of providing the wearer with the necessary control over the fin's blade portion, the wearer's foot being held in position relative to the blade portion only by the resilient material which makes up the shoe portion of the fin. The blade portion may thus flex relative to the wearer's foot during a power stroke. This, in turn, leads to increased angulation of the blade and to a decrease in the fin's propulsion effect. Known composite fins also present problems related to the difficulty in producing them, owing primarily to the difficulty encountered in providing the fins with acceptable complementary coupling structure. It is therefore an object of this invention to provide a swim fin which provides the wearer with improved control over the fin's blade portion without unnecessarily complicating the manufacture of the fin.

Many known swim fins have also failed to adequately protect the wearer's foot, often leaving large portions of the foot exposed. This is especially true where the fin is designed with comfort in mind, the wearer's toes commonly being left unprotected so as to avoid covering the toes with the rigid material which forms the fin's shoe portion or blade. Exposed toes, however, are subject to the danger of being scraped or cut, an occurrence which is unnecessarily common when wearing conventional fins. It is therefore an object of this invention to provide a differential stiffness swim fin which offers improved comfort and protection, but which does not significantly detract from the fin's advantageous hydrodynamic effects.

DISCLOSURE OF THE INVENTION

In accordance with the present invention, a swim fin having differential stiffness characteristics is provided, such fin offering both comfort and protection to the wearer without detracting significantly from the fin's hydrodynamic effect. Toward this end, the fin includes a shoe portion which receives the swimmer's foot and a blade portion which extends from the shoe portion so as to provide the desired propulsion effect. The shoe and blade portions are unitarily molded with materials of differing stiffness so as to provide a comfortable fin which offers the wearer both protection from injury and blade portion control.

The above-described objects are met by providing a fin with a shoe portion which includes a pocket having an expanse of differential stiffness which substantially overlies the forepart of the wearer's foot. The expanse, it will be appreciated, includes a resilient toe region which covers the wearer's toes and a less resilient instep region which covers the instep of the wearer's foot. Preferably, the fin is a unitary device, the shoe portion being integrally molded with the blade portion so as to substantially simplify the fin's design. The blade portion, which also generally is less resilient than the toe region, extends from the shoe portion and is operatively connected to the shoe portion's instep region, providing the wearer with instep-directed blade portion control.

The invented fin thus dispenses entirely with the need for skeletal reinforcement, improving fin safety and minimizing the weight and complexity of the fin. By forming the fin of materials having differential stiffness characteristics, it is possible to build a fin which exhibits structural integrity in the blade portion while maintaining a comfortable fit of the fin. Because the invented fin includes a resilient toe region and a less resilient instep region operatively connected to the blade portion, the wearer's toes are comfortably protected without sacrificing blade portion control. Moreover, where the remainder of the shoe portion is formed of a resilient material, a snug but comfortable fit of the fin to a wearer's foot is achieved. Further advantages of the invented fin are set forth in the detailed description which now follows.

BRIEF DESCRIPTION OF THE DRAWINGS

FIG. 1 is a top plan view showing a pair of the invented swim fins formed in accordance with a preferred embodiment of the invention.

FIG. 2 is a bottom plan view of one of the fins shown in FIG. 1.

FIG. 3 is an elevational view of the fin depicted in FIG. 2.

FIG. 4 is a cross-sectional view bisecting the fin depicted in FIG. 2.

FIG. 5 is a top plan view showing an alternative embodiment of the invented swim fin.

DETAILED DESCRIPTION OF THE PREFERRED EMBODIMENT and the Best Mode for Carrying Out the Invention As stated above, the present invention relates to an improved swim fin, such fin being formed with differential stiffness characteristics so as to enhance fin comfort and produce various advantageous hydrodynamic effects. Although useful during various aquatic activities, the fin has demonstrated particular utility during sports which demand speed and agility in the water, and is described in that context herein.

Turning now to the drawings, and referring with specificity to FIG. 1, the reader will note that a pair of swim fins formed in accordance with the present invention have been depicted, such fins being indicated generally at 10 and 10'. It should be apparent that the fins are shoe-like devices, each being configured for fitted securement to a foot of particular shape and size. Preferably, the fins are formed as left and right fins, each being suited for attachment to either a swimmer's left or right foot. In the current embodiment, fin 10 is configured for attachment to the swimmer's left foot and fin 10' is configured for attachment to the swimmer's right foot.

Upon a more careful analysis of the depicted fins, it will be appreciated that the depicted fins are substantially similar to one another, fin 10 constituting what is essentially a mirror image of fin 10'. Together, the fins mimic the characteristic shape of a dolphin's tail, providing the wearer with a fin arrangement of proven hydrodynamic design. Upon oscillating movement of the fins, an action similar to that imparted by a fish's tail a propulsive force is generated and the swimmer is able to move through the water with materially increased speed and ease and with a minimum of discomfort and fatigue.

In keeping with one of the principal objects of the invention, the depicted fins exhibit characteristics which keep the user safe and comfortable without detracting significantly from the fins' various advantageous hydrodynamic effects. Following is a more detailed description of the fin in its preferred embodiment, particular attention having been given to the various comfort-enhancing features thereof. Although the description refers specifically to fin 10, it is to be understood that such description is likewise applicable to fin 10', similar reference designators having been chosen to identify corresponding features of the depicted fins.

With reference now to FIGS. 1 through 4, the reader will more fully appreciate the shoe-like nature of fin 10, such fin being characteristically formed with a shoe portion 12 (12') and a blade portion 14 (14') which extends forwardly therefrom. The shoe and blade portions are unitarily molded, providing a fin which is easy-to-manufacture and which is of unitary design. Although no particular boundaries are defined with respect to shoe portion 12 or blade portion 14, it is to be understood that the shoe portion is that portion of the fin which receives the swimmer's foot 18 (shown generally by dashed lines in FIG. 4) and the blade portion is that portion of the fin which extends from the shoe portion to increase the foot's effective size.

As best illustrated in FIG. 4, the shoe portion includes a foot-receiving pocket 16 configured for fitted receipt of the swimmer's foot. The pocket, it will be appreciated, is defined by a top expanse or sole portion 20, a bottom expanse 22, and a pair of side walls (one of which is shown at 24). As shown, the top expanse overlies the forepart of the wearer's foot, the bottom expanse underlies the forepart wearer's foot, and the side walls rest against opposite sides of the foot. Pocket 16 thus defines a cavity which accepts the swimmer's foot as shown. By this arrangement, the top expanse provides cover for the wearer's instep and toes and the bottom expanse acts as a sole region which spans an area beneath the foot. As indicated in FIGS. 1 and 4, the bottom expanse may define one or more holes which allow the release of sand or debris which would otherwise collect in pocket 16. The side walls prevent excessive lateral displacement of the wearer's foot relative to the fin. A resilient strap 26 selectively passes around the wearer's heel so as to insure a tight-fitting relationship between the wearer's foot and the pocket of the fin.

As stated above, fin 10 also includes a blade portion 14, such blade portion extending forwardly from the shoe portion to increase the effective size of the swimmer's foot and thus to improve the foot's hydrodynamic effect. The fin's blade portion, it will be noted, is generally planar, including a central region 14a which extends from the fin's shoe portion in a plane which is essentially coextensive with top expanse 20. The blade portion is generally fan-shaped, exaggerating, to some degree, the shape of the wearer's foot. A pair of elongate ribs 28, 30 extend along the lateral boundaries of the blade portion, providing the same with increased rigidity with a minimal increase in the mass of the fin. Each rib is formed as an integral part of the fin's blade portion and projects from both the top and bottom surfaces of the fin.

Focussing attention now on the differential stiffness characteristics of the invented fin, and with particular reference to FIG. 4, the reader will see that the shoe and blade portions of the fin are divided into plural regions, each region representing an area of the fin formed from a particular material and having a resiliency within a predetermined durometer range. The boundaries between such regions are denoted by changes in cross-hatching in FIG. 4 and by faint lines in FIGS. 1 through 3. It should be appreciated, however, that the locations of such boundaries are approximate only and that where the fin is injection molded, as is preferred, the materials will mix and the boundaries may become blurred. Such blurring of boundaries will reduce the risk of disassociation of regions of the fin.

Upper expanse 20, it will be noted, includes a toe region 20a, an instep region 20b, and a flexor region 20c. The toe region covers the swimmer's toes 18a the instep region covers the wearer's instep 18b and the flexor region covers the flexing portion of the wearer's foot 18c. The toe and flexor regions are formed from a resilient, flexible material such as rubber, allowing such regions of the fin's upper expanse to deform according to flexing or extension of the wearer's foot and according to the particular physical characteristics of the swimmer's toes. The swimmer is thus given some freedom of mobility without subjecting the swimmer's toes to injury. Generally, the toe and flexor regions are formed substantially from a material having a durometer of between 10 and 45, and preferably from a material having a durometer of between 30 and 40. The toe region extends into the sole region which is similarly resilient, substantially encasing the forwardmost portion of the swimmer's foot.

As indicated, upper expanse 20 also includes a less resilient instep region 20b, which covers the instep of the user's foot. The instep region is generally formed substantially from a material having a durometer of between 45 and 90 making for a stable connection between the wearer's foot and the fin. Preferably, the instep region is formed from a natural rubber having a durometer of between 75 and 85. It will thus be appreciated that a distinct disparity exists between the resiliency of the toe region and the instep region, the instep region acting as a relatively less flexible brace over the instep of the user's foot. The instep region of the foot portion is operatively connected to the blade portion, which is also less resilient than the toe and flexor regions of the shoe portion's top expanse. In the preferred embodiment, the instep region and blade portion are molded of the same material, such material spanning a continuous area across instep region and into the blade portion of the fin. As will be appreciated by those skilled in the art, upon a power stroke (forward and downward kick of the swimmer), the instep region will engage the instep of the user's foot and transmit the force somewhat rigidly to the blade portion of the fin so as to effect a propulsive force.

Turning now to FIG. 5, it will be noted that in an alternative form of the invention, the distinctive shape of the fin may be changed so as to alter the hydrodynamic characteristics of the fin. FIG. 5 shows a swim fin 110 which includes a shoe portion 112 and a blade portion 114. Shoe portion 112 includes an upper expanse 120 having a toe region 120a, an instep region 120b and a flexor region 120c, all similar to those described above so as to allow comfortable attachment of the fin to a wearer's foot. Fin 110, however, differs from fin 10, as described above, in that its blade portion includes a central region 114a which extends from the shoe portion and a resilient perimeter region 114b which extends from region 114a. The shape and size of the perimeter region will determine the hydrodynamic effect of the fin, providing the swimmer with various hydrodynamic characteristics as desired. It should be appreciated that such perimeter region is, in the preferred embodiment, coplanar with the central region of the blade portion and that the perimeter region is more resilient than the central region to produce a particular hydrodynamic effect. Preferably the perimeter region is formed from a material having a durometer of between 10 and 45.

While the present invention has been shown and described herein with reference to the foregoing operational principals and the preferred embodiment, it will be apparent to those skilled in the art that changes in form and detail may be made without departing from the spirit and scope of the invention as defined by the appended claims.

We claim:

1. A swim fin suited for attachment to a user's foot, said fin comprising:

a shoe portion including a foot-receiving pocket, said pocket including a sole portion which underlies the forepart of the user's foot and that extends forwardly to a joinder zone located forwardly of the user's toes, and said pocket further including an overlying expanse which overlies the forepart of the user's foot, said expanse having a resilient toe region which joins with said sole portion at said joinder zone and which extends rearwardly from said joinder zone and which covers the user's toes and a less resilient instep region which covers the instep of the user's foot, said sole portion and overlying expanse being molded as a unitary body from elastomeric material; and a blade portion extending from said shoe portion, said blade portion being integrally joined to said instep region to provide for instep-directed blade portion control.

2. The swim fin of claim 1, wherein said toe region is formed substantially from a material having a durometer of between 10 and 45.

3. The swim fin of claim 1, wherein said instep region is formed substantially from a material having a durometer of between 45 and 90.

4. The swim fin of claim 1, wherein said blade portion is less resilient than said toe region.

5. The swim fin of claim 4, wherein said blade portion is formed substantially from a material having a durometer of between 45 and 90.

6. A swim fin suited for attachment to a user's foot, said fin comprising:

a shoe portion including a foot-receiving pocket and the pocket having a resilient sole portion which underlies the forepart of the user's foot and that extends to a joinder zone located forwardly of a user's toes, the pocket further including an overlying expanse which overlies the forepart of the user's foot and which joins with said sole portion at said joinder zone and which extends rearwardly from said zone to overly the forepart of the user's foot, said expanse including a resilient toe region which covers the user's toes and extends to said joinder zone and a resilient flexor region which extends adjacent the user's ankle, said expanse further including a resilient instep region which covers the instep of the user's foot which extends from the toe region to the flexor region and which has lesser resilience than the resilience of the sole portion and toe and flexor regions; and a blade portion extending from said shoe portion, said blade portion being integrally joined to said instep region to provide for instep-directed blade portion control, the blade and shoe portions being unitarily molded from elastomeric material.

7. The fin of claim 6, wherein the elastomer material of the instep region and blade portion has a durometer within the range of about 75 to 85, and the elastomer material of the sole portion and the toe and flexor regions has a durometer within the range of about 30 to 40.

* * * * *